US010770856B2

(12) United States Patent
Eder et al.

(10) Patent No.: US 10,770,856 B2
(45) Date of Patent: Sep. 8, 2020

(54) BENT ELECTRIC CONTACT ELEMENT WITH CHAMFERED EDGES AND METHOD FOR ITS MANUFACTURE

(71) Applicant: TE Connectivity Germany GmbH, Bensheim (DE)

(72) Inventors: Manuel Eder, Dinkelsbuehl (DE); Andreas Merkle, Ellenberg (DE); Matthias Schuster, Langfurth (DE); Juergen Burger, Stoedtlen (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 16/161,333

(22) Filed: Oct. 16, 2018

(65) Prior Publication Data

US 2019/0115707 A1 Apr. 18, 2019

(30) Foreign Application Priority Data

Oct. 16, 2017 (EP) ..... 17196663

(51) Int. Cl.
*H01R 43/16* (2006.01)
*H01R 13/02* (2006.01)
*H01R 12/72* (2011.01)

(52) U.S. Cl.
CPC ..... *H01R 43/16* (2013.01); *H01R 13/02* (2013.01); *H01R 12/724* (2013.01)

(58) Field of Classification Search
CPC ..... H01R 43/16; H01R 13/02; H01R 12/724
USPC ..... 439/885, 79
See application file for complete search history.

(56) References Cited

U.S. PATENT DOCUMENTS 3,492,631 A * 1/1970 Olsson ..... H01R 12/727 439/701
5,358,413 A * 10/1994 Daly ..... H01R 12/727 439/381
8,518,751 B2 * 8/2013 Sakamoto ..... H01L 23/3107 438/123
8,894,451 B2 * 11/2014 Shiratori ..... H01R 13/6471 439/660
2012/0329338 A1 * 12/2012 Umemura ..... H01R 13/2421 439/733.1
2013/0045617 A1 * 2/2013 Yoshida ..... H01R 12/778 439/345
2015/0044916 A1 2/2015 Beck et al.
2016/0099526 A1 * 4/2016 Chen ..... H01R 13/5045 439/607.05

(Continued)

FOREIGN PATENT DOCUMENTS

EP 0685907 A2 12/1995
EP 3041090 A1 7/2016
JP 3019769 B2 3/2000

OTHER PUBLICATIONS

European Patent Office Communication, dated Apr. 29, 2020, 8 pages.

(Continued)

*Primary Examiner* — Travis S Chambers
(74) *Attorney, Agent, or Firm* — Barley Snyder

(57) ABSTRACT

An electric contact element comprises a bent portion. The bent portion has a cross-section including at least one of a plastically flattened side in the bent portion or a corner that has a chamfer in the bent portion for maintaining accuracy of a bending process used to form the bent portion.

19 Claims, 2 Drawing Sheets

(56) References Cited

U.S. PATENT DOCUMENTS

2018/0036785 A1* 2/2018 Masai ..... B21D 28/16

OTHER PUBLICATIONS

Abstract of JPH09237860, also published as JP3019769, dated Sep. 9, 1997, 1 page.

* cited by examiner

BENT ELECTRIC CONTACT ELEMENT WITH CHAMFERED EDGES AND METHOD FOR ITS MANUFACTURE

CROSS-REFERENCE TO RELATED APPLICATIONS

This application claims the benefit of the filing date under 35 U.S.C. § 119(a)-(d) of European Patent Application No. 17196663.3, filed on Oct. 16, 2017.

FIELD OF THE INVENTION

The present invention relates to an electric contact element and, more particularly, to a bent electric contact element.

BACKGROUND

Using current manufacturing processes, electric contact elements do not keep their exact orientation after being bent. Thus, the actual location of a contact portion of the contact element, such as a pin or tab section, may differ from the desired location. If a plurality of parallel electric contact elements is manufactured from a strip of previously interconnected electric contact elements in the blank, a pairing effect is often observed where a pair of adjacent electric contact elements lean towards each other, leaving alternatingly smaller and larger gaps between the contact portions. Due to the drive towards miniaturization of electric connections, such deviations of the actual position of the contact section from the desired or prescribed position is not tolerable.

SUMMARY

An electric contact element comprises a bent portion. The bent portion has a cross-section with a corner that has a chamfer at least in the bent portion.

BRIEF DESCRIPTION OF THE DRAWINGS

The invention will now be described by way of example with reference to the accompanying Figures, of which.

DETAILED DESCRIPTION OF THE EMBODIMENT(S)

Figure 1:
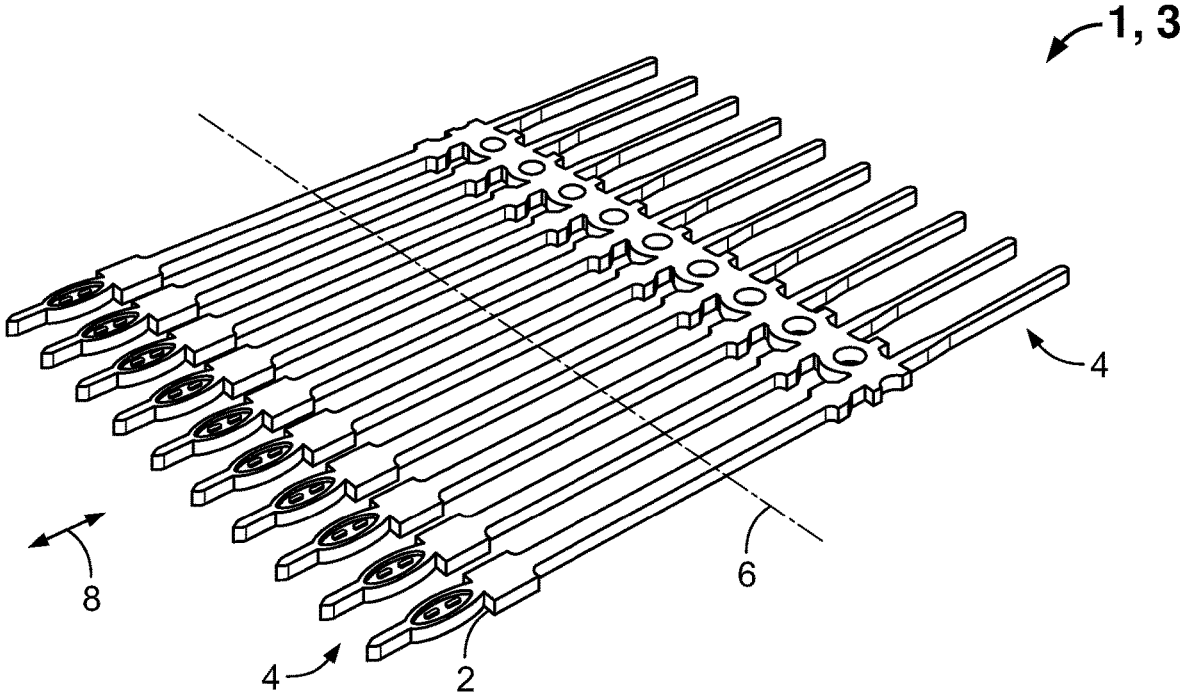
FIG. 1 is a perspective view of a blank consisting of a strip of unbent electric contact elements.

Embodiments of the present invention will be described hereinafter in detail with reference to the attached drawings, wherein like reference numerals refer to the like elements. The present invention may, however, be embodied in many different forms and should not be construed as being limited to the embodiments set forth herein; rather, these embodiments are provided so that the disclosure will be thorough and complete, and will fully convey the concept of the invention to those skilled in the art.

A strip 1 of electric contact elements 2 is shown in FIG. 1. The strip 1 has been stamped from a sheet material containing or consisting of a metal such as copper or any other electrically conductive material. This allows production of the electric contact elements 2 at a high rate by forming the strip 1 of interconnected electric contact elements 2 simultaneously as a blank 3 from the sheet metal in a die.

The strip 1 shown in FIG. 1 constitutes the blank 3 and not the final product, the electric contact elements 2 are separated from each other in the final product. The shape of the electric contact elements 2 shown in FIG. 1 is merely exemplary and is not to be construed as limiting. In an embodiment, the electric contact elements 2 each have a male or female contact section 4 at either of their free ends. The disclosure herein also relates to an electric contact element 2 which is not formed as part of a strip 1.

The strip 1, as shown in FIG. 1, may be used for header pins and tabs and, in the shown embodiment, is bent about an axis 6 which extends perpendicular to a longitudinal direction 8 of the electric contact element 2. In the embodiment of the strip 1 shown in FIG. 1, the longitudinal directions 8 of all electric contact elements 2 are parallel to each other. The longitudinal direction 8 is determined by the elongated shape of the electric contact element 2, where the dimension along the longitudinal direction 8 is significantly larger than the other two perpendicular dimensions.

If the electric contact elements 2 are bent about axis 6, it is important that they do not lose their relative orientation, for example, that they remain parallel to each other, and that the contact sections 4 after bending are located within a pre-determined position tolerance.

Figure 2:
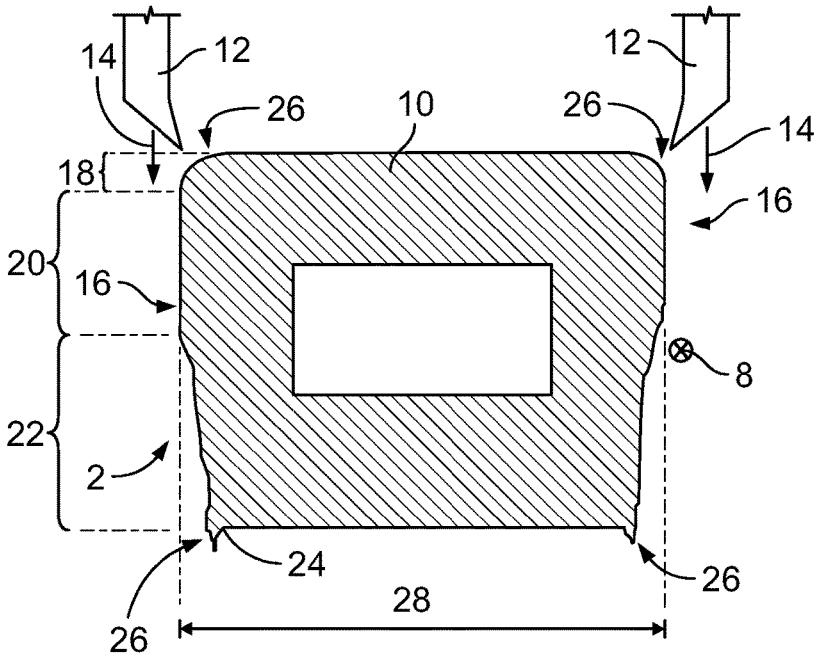
FIG. 2 is a sectional side view of an electric contact element after cutting.
Figure 3:
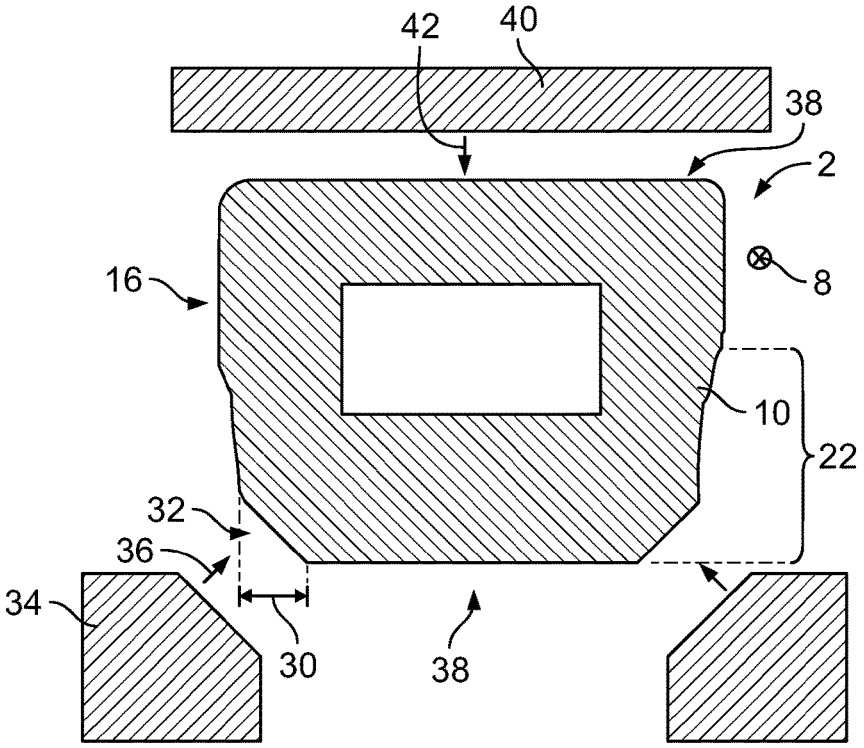
FIG. 3 is a sectional side view of the electric contact element after forming a chamfer.

In FIGS. 2 and 3, a cross-section 10 of an electric contact element 2 perpendicular to the longitudinal direction 8 at the position of the axis 6 is shown. FIG. 2 shows the cross-section 10 right after cutting the electric contact element 2 from the metal sheet (not shown). Cutting is performed by two shearing knives 12, which are shown schematically in FIG. 2. The shearing knives 12 are moved along a cutting direction 14 to separate the contact element 2 from the surrounding sheet. The rectangular cross-section 10 shown in FIG. 2 results from the cutting by the shearing knives 12. The sides 16 along which the separation takes place are sheared off from the surrounding material.

The shearing leaves a typical structure of the sheared sides 16 shown in FIG. 2. A roll-over section 18 is characterized in the cross-section 10 by material which is plastically drawn by the shearing knife 12 in the cutting direction 14 when the shearing edge 12 enters the material. The roll-over section 18 is recognizable by a radius-like shape, which, however, may vary depending on the wear of the sheared edge 12, its angles, and the cutting velocity. Following the roll-over section 18, there is a burnish section 20, where the material is clearly sheared off. The burnish section 20 is comparatively smooth and extends almost planarly in the cutting direction 14.

As shown in FIG. 2, following the burnish section 20 in the cutting direction 14 is a fracture section 22 which is caused by material, which is not cut, but breaks off due to excessive stress generated by the shearing edges 12. The fracture section 22 is less planar and rougher than the burnish section 20. Finally, the sheared side 16 terminates in the cutting direction 14 in a burr 24. The roll-over section 18, burnish section 20, fracture section 22, and burr 24 are all invariably present in an electric contact element 2 which has been formed by shearing. The exact relative lengths of these four section, however, may vary.

Although the structure of a sheared side 16 has been explained in FIG. 2 only with reference to the left-handed side of the cross-section 10 depicted therein, any other sheared side 16, such as the sheared side on the right-hand side, has the same general structure.

A bending process of the electric contact element 2 becomes more accurate if at least one of the corners 26 is chamfered. The chamfer 32, shown in FIG. 3, has a chamfer width 30 that extends over at least 10% of the nominal width 28 of the contact element 2, where both widths 28, 30 are measured in the same direction. In various embodiments, the chamfer 32 is inclined between 30° and 60°, or around 45°, relative to at least one of the adjacent sides.

Better bending results have been obtained if the chamfer 32 is formed in the fracture section 22, i.e. if the formation of the chamfer 32 is used for deburring or removing the burr 24.

In an embodiment, the chamfer 32 is formed by plastic deformation, in particular by stamping, for example by pressing a swage 34 against the respective corner 26 as shown in FIG. 3. The motion direction 36 of the swage 34 may be inclined with respect to both sides 16, 38 which are joined by the corner 26. In various embodiments, the motion direction 36 may be inclined between 30° and 60°, or around 45° with respect to any of the sides 16, 38. The chamfer 32 is thereby disposed at an end of the fractured section 22 of the sheared side 16.

As shown in FIG. 3, a chamfer 32 may be formed wherever a burr 24 has been formed by the preceding cutting operation. A further improvement of the accuracy of the bending of the contact element 2 may be achieved when at least one side 38 of the cross-section 10 is plastically flattened. This can be achieved by moving another swage 40 against the side 38 in a direction 42 that is perpendicular to the side 38 which is to be flattened. The swage 40 covers all of the side 38 at least in a direction perpendicular to the longitudinal direction 8.

Positioning the contact sections 4 after bending within tight tolerances has been achieved when the flattened surface is located opposite the at least one chamfer 32 as shown in FIG. 3. The flattened surface 38 does not need to border a chamfer 32. The swages 34, 40 need only to extend in the longitudinal direction 8 along the portion of the contact element 2 that will be bent in the next step or one of the subsequent steps. They do not need to extend also along sections which will not be bent.

Figure 4:
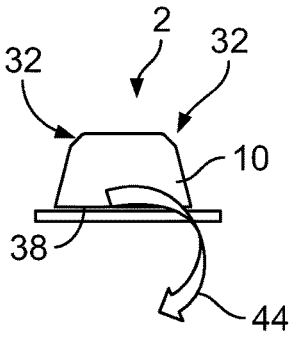
FIG. 4 is a side view of a process of bending the electric contact element.

After the at least one chamfer 32 has been formed and, optionally, the side 38 has been flattened, the electric contact element 2 is bent about axis 6, for example, by 90°. In other embodiments, other bending angles are also possible. The accuracy of the bending is improved if the at least one chamfer 32, or two chamfers 32 as shown in FIG. 3, are at the radially outward-facing side 43 in the bent portion, as shown in FIG. 4 where the bending direction 44 is indicated by an arrow. The flattened side 38 forms the radially inward-facing side 45 at the bent portion of the electric contact element 2.

Figure 5:
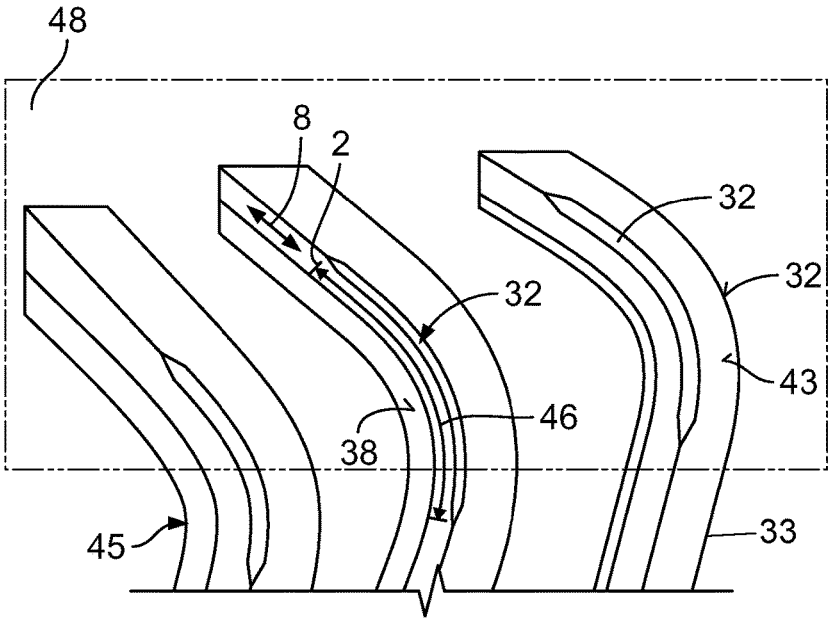
FIG. 5 is a perspective view of a bent portion of the electric contact element.

FIG. 5 shows the bent portion 46 of an electric contact element 2. The chamfer 32 extends at least along the bent portion 46 in the longitudinal direction 8. The flattened side 38 is opposite the chamfer 32 at the radially inward-facing side of the bent portion 46. The at least one chamfer 32 and the flattened side 38 improve the accuracy of the bending process, especially when a plurality of electric contact elements 2, which may in particular be parallel to each other along respective linear portions 33, are bent simultaneously so that maintenance of the parallel orientations is maintained. Further, as shown in FIG. 5, the electric contact element 2 may be part of an electric connector 48, such as a header.

What is claimed is:

1. An electric contact element, comprising:
- a linear portion; and
- a bent portion extending from the linear portion and having a cross-section including:
  - a corner that has a chamfer inclined between 30 degrees and 60 degrees, relative to at least one of an adjacent side, at least in the bent portion, the chamfer disposed at an end of a fracture section of a sheared side of the cross-section; and
  - a plastically flattened side arranged only in the bent portion.

2. The electric contact element of claim 1, wherein the corner that has the chamfer is located at a radially outward-facing side of the cross-section of the bent portion.

3. The electric contact of claim 1, wherein the chamfer is formed only in the bent portion.

4. The electric contact element of claim 1, wherein the chamfer is formed in the corner by plastic deformation of the electric contact element.

5. The electric contact element of claim 4, wherein the corner that has the chamfer borders a sheared side of the electric contact element.

6. The electric contact element of claim 1, wherein the side of the cross-section that is plastically flattened is disposed opposite the chamfer.

7. The electric contact element of claim 6, wherein the side of the cross-section that is plastically flattened is disposed on a radially inward-facing side of the bent portion.

8. A blank, comprising:
- a strip of a plurality of interconnected electric contact elements, each of the electric contact elements including a bent portion having a cross-section with a corner that has a chamfer inclined between 30 degrees and 60 degrees, relative to at least one of an adjacent side, at least in the bent portion and a radially inward facing plastically flattened side formed only in the bent portion.

9. An electric connector, comprising:
- a plurality of electric contact elements each including:
  - a linear portion;
  - a bent portion extending from the linear portion and having a cross-section with a corner that has a chamfer inclined between 30 degrees and 60 degrees, relative to at least one of an adjacent side, formed only in the bent portion.

10. The electric connector of claim 9, wherein each contact element further comprises a plastically flattened side formed only in the bent portion.

11. A method of manufacturing an electric contact element, comprising:
- forming the electric contact element by shearing;
- after the forming step, flattening a side of the electric contact element by plastic deformation;
- chamfering a corner of a cross-section of the electric contact element; and
- bending the electric contact element in a bent portion of the electric contact element, the corner has a chamfer inclined between 30 degrees and 60 degrees, relative to at least one of an adjacent side, at least in the bent portion.

12. The method of claim 11, wherein the chamfering step occurs after the forming step and before the bending step.

13. The method of claim 11, wherein the chamfering step includes moving a swage against the electric contact element to form the chamfer by plastic deformation.

14. The method of claim 11, wherein the chamfer is formed at an end of a fracture section of a sheared side of the electric contact element.

15. The method of claim 11, wherein the flattened side comprises a side of the electric contact element opposite the chamfer.

16. The method of claim 11, wherein the chamfering step occurs after the forming step or before the bending step.

17. The method of claim 11, wherein the step of chamfering a corner of a cross-section of the electric contact comprises chamfering a corner of the cross-section only in an area where the electric contact is bent in the bending step.

18. The method of claim 11, wherein the step of flattening a side of the electric contact element comprises flattening the side of the electric contact only in an area where the electric contact is bent in the bending step.

19. The method of claim 11, wherein the step of flattening a side of the electric contact comprises flattening only one side of the electric contact.

* * * * *